US009133004B2

(12) United States Patent
Clüsserath

(10) Patent No.: US 9,133,004 B2
(45) Date of Patent: Sep. 15, 2015

(54) METHOD AND FILLING SYSTEM FOR PRESSURE-FILLING CONTAINERS

(75) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 616 days.

(21) Appl. No.: 13/515,675

(22) PCT Filed: Jan. 14, 2011

(86) PCT No.: PCT/EP2011/000156

§ 371 (c)(1), (2), (4) Date: Jun. 13, 2012

(87) PCT Pub. No.: WO2011/091956

PCT Pub. Date: Aug. 4, 2011

(65) Prior Publication Data

US 2012/0255644 A1 Oct. 11, 2012

(30) Foreign Application Priority Data

Jan. 27, 2010 (DE) ..... 10 2010 006 028

(51) Int. Cl.
*B67C 3/12* (2006.01)
*B67C 3/28* (2006.01)

(52) U.S. Cl.
CPC .. *B67C 3/12* (2013.01); *B67C 3/288* (2013.01)

(58) Field of Classification Search
CPC . B67C 3/286–3/288; B67C 3/20; B67C 3/12; B67C 3/283
USPC ..... 141/4, 39, 59, 95, 144–152; 700/3, 301
See application file for complete search history.

(56) References Cited

U.S. PATENT DOCUMENTS

| | | | | |
|---|---|---|---|---|
| 5,273,082 | A * | 12/1993 | Paasche et al. | 141/6 |
| 6,474,368 | B2 * | 11/2002 | Clusserath et al. | 141/6 |
| 7,647,950 | B2 * | 1/2010 | Clusserath | 141/56 |
| 8,701,719 | B2 * | 4/2014 | Clusserath | 141/9 |
| 2005/0029057 | A1 | 2/2005 | Jeon | |
| 2013/0284307 | A1 * | 10/2013 | Angerer | 141/1 |
| 2013/0306190 | A1 * | 11/2013 | Tanaka et al. | 141/1 |

FOREIGN PATENT DOCUMENTS

| | | |
|---|---|---|
| DE | 29502868 | 4/1995 |
| DE | 10008426 | 8/2001 |
| DE | 10359246 | 3/2005 |
| EP | 1447329 | 8/2004 |
| GB | 2288168 | 10/1995 |
| WO | 2005/056464 | 6/2005 |
| WO | 2005/080202 | 9/2005 |

* cited by examiner

*Primary Examiner* — Timothy L Maust
*Assistant Examiner* — Timothy P Kelly
(74) *Attorney, Agent, or Firm* — Occhiuti & Rohlicek LLP

(57) ABSTRACT

A filling system pressure-fills containers with a filling material using filling elements for filling containers against a counter-pressure using a multi-phase treatment process that includes pre-pressurizing a container to a first pressure, filling them, and relieving the containers to ambient pressure. The system has a single pressure-measuring device, and a control device. The pressure-measuring device detects an internal-pressure profile for all filling elements during the treatment phases, and provides timing control of treatment duration of the phases. The control device either monitors or corrects treatment durations of all treatment phases of all the filling elements based at least in part on an internal-pressure profile detected by the pressure-measuring device.

14 Claims, 2 Drawing Sheets

METHOD AND FILLING SYSTEM FOR PRESSURE-FILLING CONTAINERS

CROSS REFERENCE TO RELATED APPLICATIONS

This application claims priority to international application no. PCT/EP2011/000156, filed Jan. 14, 2011, which claims the benefit of Jan. 27, 2010 priority date of German application no. 10 2010 006 028.3. The aforementioned applications are incorporated herein in their entirety.

FIELD OF DISCLOSURE

This disclosure relates to pressure-filling bottles, cans, or similar containers.

BACKGROUND

Pressure-filling is a way to fill bottles, cans, or other containers with a liquid filling material under counter-pressure. Examples of counter-pressure include clamping pressure and filling pressure.

Known pressure-filling methods have in common a multiphase filling process. In a preparation phase, the container presses against the filling element to form a seal. An inert gas, such as carbon dioxide gas, then pre-pressurizes the container's interior to the counter-pressure. A subsequent filling phase includes filling the container with the liquid filling material under counter-pressure. During a relief phase that follows, the pressure within the container is relieved to ambient pressure. This pressure-relief is preferably performed in stages. A first stage involves relieving the pressure to a pre-relief pressure that is above ambient pressure. The second stage takes the pressure the rest of the way to ambient pressure.

Usually, the filling process features still further treatment phases. For example, there may also be an evacuation phase in which the container's interior is evacuated. There may be a rinsing phase, in which the container's interior is rinsed with inert gas. In some cases, there are several alternating, successive evacuation and rinsing phases. The individual treatment phases can themselves have several partial phases. For example, the filling phase can have partial phases for slow priming, for fast filling, for slow residual filling, for steadying the filling material, etc.

In known methods and filling systems, the initiation and termination of essential treatment phases is time-controlled. In these cases, treatment durations for individual treatment phases are saved in a computerized controller of the filling system. This data can be saved in a product-specific manner and/or a container-specific manner.

Treatment durations for individual treatment phases are usually obtained from experience. These durations take into account the switching times required for opening and closing the valves that control the treatment media during the treatment phases. One disadvantage of this is that the actual sequence of the treatment phases is not monitored and the knowledge of appropriate treatment durations depends heavily on the experience of the particular operating staff. Even the smallest lack of attention and/or inaccuracy can lead to either a reduction in the quality of the filled product, an increase in the consumption of inert gas, or both.

A known method for pressure-filling containers includes monitoring and/or diagnosing individual filling elements during the filling process to detect a malfunction of the filling elements early and to initiate countermeasures. This requires a separate pressure sensor at each filling element for measuring the pressure profile.

Such a method also aims to optimize the duration of the relief phase upon completion of the actual filling process. This includes providing a pressure sensor at a filling element to measure the profile of the container's internal pressure during the relief phase and for defining the duration of the relief phase for all filling elements of the filling system.

SUMMARY

The invention avoids the above-mentioned disadvantages and creating, in a method for pressure-filling containers, a possibility of objectively checking and/or monitoring the treatment phases and their sequence, and optimally adapting the treatment times to actual requirements.

In one aspect, the invention features a method for pressure-filling a container with a liquid filling material using a filling system that includes a filling element group having filling elements. During a first treatment phase, the container is arranged in a sealed position at a filling element from the plurality of filling elements and pre-pressurized with an inert gas to a counter-pressure that is either a clamping pressure or a filling pressure. Then, during a second treatment phase, the container is filled against said counter-pressure. During a third treatment phase that follows the second treatment phase, the container is relieved to ambient pressure. A timing control determines treatment duration of the treatment phases. During all treatment phases, a pressure profile of an internal pressure of the container is detected. The inventive method includes, using a pressure-measuring device, detecting an internal-pressure profile of a selected container only at a first filling element of the filling element group, and based at least in part on the internal-pressure profile, for all treatment phases of all filling elements of the filling element group, either monitoring treatment duration or correcting treatment duration.

Some practices include comparing the internal-pressure profile with a nominal pressure profile for either monitoring and correcting a treatment duration or correcting treatment duration, displaying a sequence of treatment phases, or monitoring a sequence of treatment phases.

Other practices include, prior to the first treatment phase, applying a further treatment phase, and detecting an internal-pressure profile within the container during the further treatment phase. Practices include those in which the further treatment phase includes filling the container, and evacuating the container. Other practices include those in which the further treatment phase includes rinsing the container with inert gas. Among all of these practices are those in which the internal-pressure of the container during the further treatment phase is smaller than the counter-pressure.

Some practices of the invention also include providing the pressure-measuring device at one filling position of a rotary filling machine having filling positions. In these practices, each of the filling positions comprises a filling element at a rotor that is driven to rotate about a vertical machine axis.

Yet other practices of the invention include providing the pressure-measuring device at a location that is diametrically opposed to another pressure-measuring device located at another filling position. In these practices, diametric opposition is defined in relation to a vertical machine axis of a rotor of a rotary filling machine having filling positions, each of which comprises a filling element at the rotor. In these practices, the rotor is driven to rotate about the vertical machine axis.

Other practices include saving first data in a computer of the filling system. The first data in these practices is either container-specific data or product-specific data and includes, in either case, either changed or corrected treatment duration.

In another aspect, the invention features an apparatus for controlling a filling system for pressure-filling containers with a liquid filling material in one multi-phase filling process that uses a filling-element group that is part of a plurality of filling elements for filling the containers against a counter-pressure, which is either a clamping pressure or a filling pressure, using a multi-phase treatment process that includes, in a first treatment phase, pre-pressurizing a container with an inert gas to the first pressure, in a second treatment phase, filling the container to the counter-pressure, and in a third phase after the second phase, relieving the container to ambient pressure. The inventive apparatus includes a single pressure-measuring device, and a control device. The single pressure-measuring device detects an internal-pressure profile for all filling elements during the treatment phases, provides timing control of treatment duration of the phases, and either monitors or corrects treatment durations of all treatment phases of all filling elements of the filling element group based at least in part on an internal-pressure profile detected by the pressure-measuring device.

Embodiments of the invention includes those in which the control device also compares the internal-pressure profile with a nominal pressure profile and either displays a sequence of treatment phases, monitors a sequence of treatment phases, changes a treatment duration, or corrects a treatment duration.

In other embodiments, the control device corrects treatment duration of all treatment phases based at least in part on the pressure profile.

In yet other embodiments, the pressure-measuring device is provided at one filling position of a rotary filling machine having a plurality of filling positions, each of which comprises a filling element at a rotor that is driven to rotate about a vertical machine axis.

In yet other embodiments, the pressure-measuring device is opposite another pressure-measuring device that is located at a filling position that is diametrically opposed to the pressure-measuring device. In these embodiments, diametric opposition is defined in relation to a vertical machine axis of a rotary filling machine having a plurality of filling positions, each of which comprises a filling element at a rotor that is driven to rotate about the vertical machine axis.

In another embodiment, the control device saves either a changed treatment duration or a corrected treatment duration.

The invention is based on the recognition that the pressure profile of the internal pressure of a particular container that is sealed against a filling element during the filling process contains all the required information about the sequence of the individual treatment phases. This pressure profile provides information on whether the filling process or its treatment phases are proceeding or have proceeded in the desired manner. The pressure profile provides such information even for more complex filling processes or filling methods, such as the low-oxygen filling of beer or the filling of other products containing $CO_2$. The pressure profile in the particular container enables complete tracing and/or monitoring of the individual treatment phases, including those that materially affect the quality and shelf life of the filled product. For example, in a more complex filling process with evacuation phases interspersed with $CO_2$ rinsing phases, the correct sequence of these phases is critical both for the subsequent $CO_2$ concentration and also for the oxygen content in the filling material. This has a significant effect on the shelf life of the filling material within a filled container.

A major advantage of the invention is that the accurate determination and calculation of gas composition within particular container and thus, the $CO_2$ and oxygen content within a container, by taking into account the pressure profile of the internal pressure of the container and by applying, for example, the equation of state for (real) gases $P*V=m*R*T$. Thus, for example, the gas composition within a container after the individual treatment phases can easily be determined. For example, the gas composition after the first, second, and third pre-evacuations can be determined to ascertain the effects of intervening first and second rinses with pure $CO_2$ gas.

The invention also enables the optimal design of the particular filling process. In particular, the invention permits optimization of the consumption of inert gas or $CO_2$ gas while easily taking into account different container volumes. This permits a filling process to result in a low oxygen intake or concentration in the filling material, thus maximizing shelf life, while consuming the smallest amount of $CO_2$ in the process, thus reducing material costs.

To keep the hardware and software measurement and control requirements as low as possible, the filling positions of the filling system form at least one group with several filling positions to which a filling position with a pressure-measuring device is then allocated. The pressure-measuring device enables common monitoring, setting and/or correction of the treatment times of all filling positions of the group. Using the measured pressure profile, it is possible to make statements regarding the sequence of the treatment phases at all filling positions of the group.

The invention also enables statements to be made regarding a correction or change of the treatment time of one or more treatment phases. Such statements include statements concerning the start time and the duration. These statements are made based on a comparison between the measured or actual pressure profile and a specified or saved nominal pressure profile or corresponding nominal values. This change or correction is then executed, for example by changing the start and/or the end of a particular treatment phase. This results in obtaining the required internal pressure of the container for that phase. This setting and/or correction of the treatment times can be performed manually or by machine. It can also be performed for all filling positions of the group.

If the filling system is a rotary filling machine, then only one filling position or one filling element or only two filling elements diametrically opposed in relation to a machine axis with a pressure-measuring device detecting the internal pressure of the container will be implemented. The treatment times of all filling elements are then changed and/or corrected according to the pressure profile of the internal pressure of the container detected by these measuring devices.

In some embodiments and practices, control or regulation of the treatment time includes saving, in a machine-control of the filling system, a valid pressure profile. Such a pressure profile is a product-specific and container-specific nominal pressure profile for the particular filling material or product to be filled and for the type of the containers to be filled. The pressure profile can be saved together with nominal control times for the valves controlling the individual treatment phases of the filling process. These nominal control times are based on values from the past.

During the filling process, the pressure-measuring device at least intermittently detects the pressure profile of the internal pressure of the container at the filling position concerned. This generates an actual pressure profile. This actual pressure profile and the nominal pressure profile or corresponding data provide a basis for making a statement regarding the sequence of the treatment phases. They also provide a basis for making a statement regarding setting and/or correction of the treatment duration and/or treatment times. This would include statements concerning the current points in time and time intervals at which the valves that control individual treatment phases are to be opened and/or closed not only for those filling positions that have the pressure-measuring device but also for those filling positions that do not have the pressure-measuring device.

Some embodiments or practices include continuous detection of the actual pressure profile. These embodiments and practices include continuously ascertaining required corrections or changes of the treatment times and executing those corrections or changes at the filling positions.

In a preferred embodiment, the pressure profile ascertained by the pressure-measuring device continues to be stored in a computer, preferably in the computer controlling the filling system, so that this pressure profile can be shown on a display or operator screen at any time.

Some embodiments and practices include providing software limit values for the monitoring of the actual pressure profile. In these embodiments, exceeding and/or going below such limit values causes the change or correction of the treatment times and/or triggers alarm functions and/or error messages.

Some embodiments include analogous monitoring of the relief phase. In these embodiments, the advantage of the invention is especially apparent for filling systems or filling machines in which, to avoid having a further gas channel or ring channel at the rotor, the residual relief is performed directly in a ring channel that serves as a vacuum channel. In these filling systems, a careful setting of the treatment duration or relief duration is necessary because exceeding the treatment duration, even for a short time, can lead to an insufficient pressure or even to a vacuum. Either case results in an unwanted foaming of the filled product in the container. In some embodiments and practices of the invention, these problems are solved by accurately setting the treatment duration of the residual relief phase, and doing so while taking into account the pressure profile detected by the pressure-measuring device.

In some embodiments, it is possible to remotely maintain or diagnose the operation of a filling machine, for example by transmitting pertinent data to the manufacturer of the filling machine. In these embodiments, the invention also includes transmitting the measured pressure profiles or the corresponding data over a communication network. The network can be an internal or external communication network. Transmission can occur over the Internet or an associated server(s) to at least one workstation or computer within the company that is operating the filling machine or the filling system and/or to a location geographically distant therefrom. This permits remote maintenance and/or diagnostics by specialists from the manufacturer of the filling machine or the filling system.

In the context of the present invention, the term "pressure profile" refers to levels of pressure that are measured or ascertained at short time intervals to yield an approximation of a function of pressure over time.

BRIEF DESCRIPTION OF THE FIGURES

These and other features and advantages of the invention will be apparent from the following detailed description, and the accompanying figures, in which.

DETAILED DESCRIPTION

Figure 1:
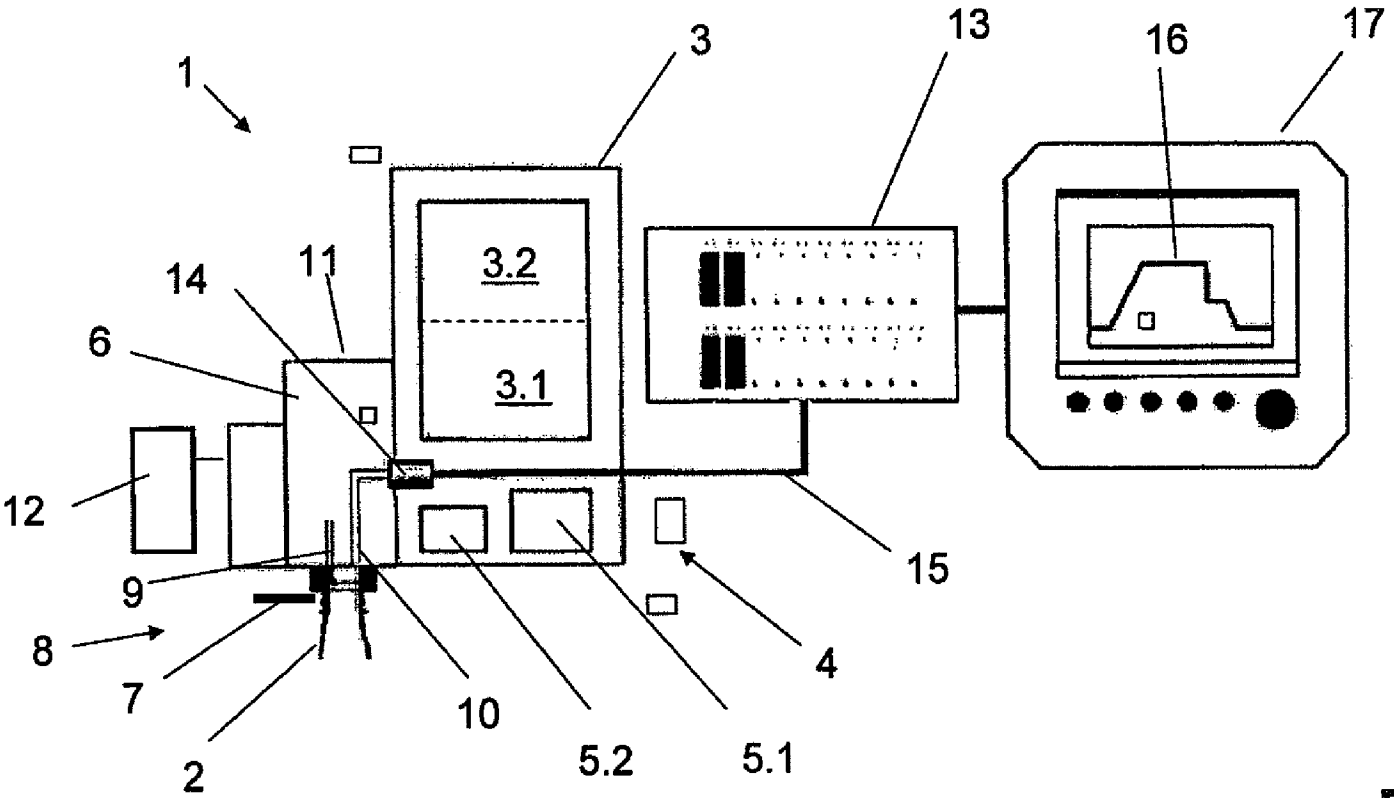
FIG. 1 is a simplified schematic diagram of a filling position of a filling machine for pressure-filling bottles, together with a process computer for controlling the treatment times.

FIG. 1 shows a filling machine 1 for pressure-filling containers, such as bottles 2, with a liquid filling material. A typical liquid filling material is a drink, including a carbonated drink, such as beer.

Only a section of the filling machine 1 through a ring bowl 3 is shown. The ring bowl 3 is part of a rotor 4 that can be driven to rotate about a vertical machine axis.

During the filling operation, liquid filling material partially fills the interior of the ring bowl 3. This forms a lower liquid space 3.1 and a gas space 3.2 above the liquid space 3.1. The liquid filling material occupies the liquid space 3.1. Inert gas under pressure, for example $CO_2$ gas under pressure, occupies the gas space 3.2. Regulation and/or control elements (not shown) control the level of the liquid filling material in the ring bowl 3 so that it remains at a specified level. The inert gas pressure is set or controlled in the gas space 3.2 to a specified counter-pressure having a first value. The counter-pressure having the first value is either a filling pressure or a clamping pressure.

First and second ring channels 5.1, 5.2 are formed in the rotor 4 or in the part of the rotor 4 that forms the ring bowl 3. The first ring channel 5.1 is an inert gas collection channel that guides the inert gas with a slight excess pressure having a second value. The second ring channel 5.2 is a vacuum channel. During a filling operation, the second ring channel 5.2 has a vacuum pressure having a third value.

Filling elements 6 are distributed at equal angular distances from each other around the circumference of either the rotor or the ring bowl 3. A filling element 6 and an associated container carrier 7 together form a filling position 8. At each filling position 8, a container carrier 7 suspends a bottle to be filled. The container carrier 7 uses the container's flange or mouth flange to do so. The bottles 2 are pressed into a sealed position against the particular filling element 6 in the area of a discharge port 9 for the liquid filling material as well as a gas port 10 for evacuation or clamping, as clarified below.

Each filling element 6 has a liquid channel that connects to the liquid space 3.1. Each filling element 6 also has a controlled liquid valve. This liquid channel and its associated liquid valve enable controlled discharge of the liquid filling material into a particular bottle 2.

Each filling element 6 also has gas routes for the controlled treatment of the interior of a bottle 2 with a vacuum, a rinsing gas, or a pre-clamping gas. These gas routes can also be used for the control of slow and quick filling phases, for the relief of a particular filled bottle, or both. A valve block 11 houses the valves for controlling these gas routes. The valves housed by the valve block 11 can include pneumatic valves selected via an electro-pneumatic control valve arrangement 12 by a computer 13.

Only a filling position 8 or the local filling element 6 is equipped with a pressure sensor 14. During the particular filling process, the pressure sensor 14 detects the internal pressure of the bottle 2 located at the filling element 6 via the gas port 10. It then supplies a corresponding measurement signal to the computer 13 via the measurement line 15. The measurement signal is used in connection with creating and saving the pressure profile 16, over time, of the internal bottle pressure of the bottle 2 located at the filling element or of a corresponding data record.

During bottle filling, each bottle 2 is handed over, at a container in-feed of the filling machine 1, to a container carrier 7. The container carrier 7 presses the bottle 2 against the associated filling element 6 so that the bottle's mouth is against a seal of the filling element 6. The seal is arranged in the area of the discharge port 9 and the gas port 10. With the bottle 2 in a sealed position, both the discharge port 9 and the gas port 10 connect with the interior of the bottle 2. The filled bottles 2, having been lowered with the container carrier 7 from the filling element 1, are removed at a container out-feed of the filling machine 1 and delivered to, for example, a closing machine.

Within the angular range of the rotary motion of the rotor 4 between the container in-feed and the container out-feed, the filling of the bottles 2 is performed in several treatment phases one after the other. These phases include a triple-evacuation, a partial pre-clamping of the bottle, a pre-clamping of the bottle, a fast filling of the bottle, a slow filling of the bottle, a steadying of the filling material in the bottle, a pre-relief of the bottle, and a subsequent relief of the bottle.

Triple-evacuation includes connecting the interior space of the bottles to the second ring channel 5.2 three times. An inert gas rinse of the interior space of the bottles occurs between the first and second evacuations or the second and third evacuations. This can be achieved by connecting the interior space of the bottles to the first ring channel 5.1.

Partial pre-clamping of the bottle 2 is carried out by connecting the interior space of the bottles to the first ring channel 5.1 and/or to the gas space 3.2.

Connecting the interior space of the bottles with the gas space 3.2 that is at the final clamping or filling pressure, which has the first value, carries out the pre-clamping of the bottle 2.

The fast filling of the bottle 2 with the liquid filling material from the liquid space 3.1 is carried out with an opened liquid valve at the clamping and filling pressure having the first value.

The slow filling of the bottle 2 is carried out at the clamping and filling pressure having the first value prior to closing the liquid valve and shortly before reaching the required filling level and/or filling quantity.

The steadying of the filling material in the bottle 2 is carried out at the pre-clamping and filling pressure having the first value and with the liquid valve closed.

The pre-relief of the bottle 2 is carried out at a pre-relief pressure substantially below the clamping and filling pressure having the first value, for example at the slight excess pressure having the second value.

The subsequent residual relief to atmospheric or ambient pressure is carried out by connecting the part of the interior space of the bottle that is not taken up by the filling material to the second ring channel 5.2 via the gas port 10.

Figure 2:
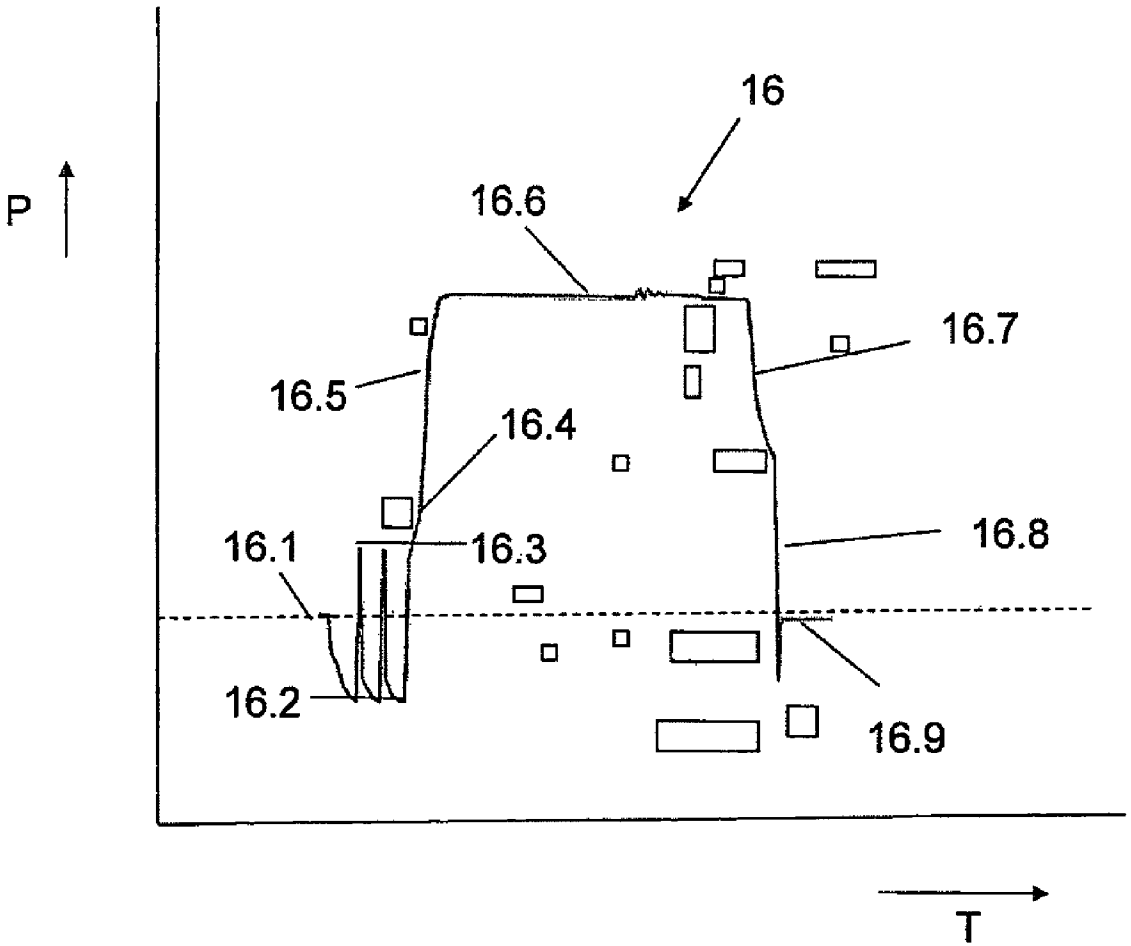
FIG. 2 shows the pressure profile within a bottle during a filling process involving several treatment phases.

FIG. 2 also schematically shows the pressure profile 16 detected by the pressure sensor 14 at the filling element 6. The profile includes a first section 16, which includes the start of the filling process, a second section 16.2, which includes pre-evacuation of the bottle 2, a third section 16.3, which includes inert gas rinsing of the bottle 2, a fourth section 16.4, which includes partial pre-clamping of the bottle 2, for example to the slight excess pressure having the second value, a fifth section 16.5, which includes pre-clamping of the bottle 2 to the clamping or filling pressure having the first value, a sixth section 16.6, which includes fast filling, slow filling, and steadying, a seventh section 16.7, which includes pre-relief, for example to the slight excess pressure having the second value, an eighth section 16.8, which includes residual relief to atmospheric pressure, and a ninth section 16.9, which includes the end of the filling process.

As mentioned above, the pressure profile during the filling process, and, in particular, the pressure profile during the individual treatment phases, determines the sequence of these phases. The pressure profile thus plays a critical role in determining the quality and the shelf life, in particular the $CO_2$ and oxygen content of the filled product. By detecting the pressure profile 16, it is thus possible to not only check and monitor, but also to control the filling process or the treatment phases.

Given the plurality of the filling elements 6 of the filling machine 1, it is generally not possible to attain direct pressure-dependent control of the filling element 6 with reasonable control requirements. Instead, it is necessary to perform the individual treatment phases of the filling process in a time-controlled manner, namely in a manner that is synchronous with the rotary motion of the rotor 4 and with treatment times saved in the computer 13. These save treatment times enable a selection to be made, over time, including the selection of the valves of the electro-pneumatic control valve devices 12 and of the valve blocks 11. The treatment times or control times, which also include the time intervals between the discontinuation of a control signal and the actual complete switching (e.g. opening or closing) of a valve, are thus, for example, selected such that, given the volume of the bottles 2 and the pressure of the medium used for the particular treatment phase, the desired result of the treatment phase can be achieved as often as possible.

To monitor this time control of the treatment phases of the filling process and to adapt it to the ideal pressure profile of the filling process as optimally as possible, the actual pressure profile 16 is measured at those filling positions 8 that are equipped with the pressure sensor 14 and saved at least temporarily in the computer 13. This actual pressure profile 16 can then be compared, for example, with a nominal pressure profile that is ideal for the filling material concerned and for the type of the bottles 2 and saved in the computer 13 or compared with corresponding nominal data. For clear deviations, i.e. deviations that exceed specified limit values, between the measured actual pressure profile and the nominal pressure profile in one or several treatment phases, the treatment times (beginning and/or end) of these treatment phases for all filling elements 6 of the filling machine 1 are then jointly changed such that the actual pressure profile corresponds to the nominal pressure profile with sufficient accuracy. With the new or corrected treatment times, the subsequent control of all filling elements 6 is then performed during the particular filling process.

In some cases, the correction is performed manually depending on the graphic representation on a picture monitor 17 of the computer 13. In other cases, the correction is automatically controlled by computer. Furthermore, the corrected treatment times are saved in the computer 13 as treatment times typical of the type of bottles 2 and of the filling material concerned so that, for a subsequent fresh filling of the same bottles 2 or the same bottle type with the same filling material, these treatment times or this data can be drawn on for the control of the filling process.

In particular, when the filling machine 1 is used for the first time to fill bottles 2 of a particular type with filling material of a particular type, there is the possibility of entering the treatment times based on experience-related values. These treatment times can be entered into the computer 13 at an operator monitor 17 using an input keyboard. In a trial run of the filling machine 1, treatment times thus entered are corrected accordingly in the manner described above by comparing the measured actual pressure profile with the nominal pressure profile. The actual measured pressure profile can then be saved in the computer 13 and reused to represent data typical of the type of container and filling material concerned. Other ways of controlling the filling machine 1 are possible with the design according to the invention.

Having described the invention, and a preferred embodiment thereof, what is claimed as new, and secured by Letters Patent is:

1. A method for pressure-filling a container with a liquid filling material using a filling system comprising a filling element group, said filling element group comprising a plurality of filling elements, wherein, during a first treatment phase, said container is arranged in a sealed position at a filling element from said plurality of filling elements and pre-pressurized with an inert gas to a counter-pressure, said counter-pressure being selected from the group consisting of a clamping pressure and a filling pressure, wherein, during a second treatment phase, said container is filled against said counter-pressure, wherein during a third treatment phase following said second treatment phase, said container is relieved to ambient pressure, wherein treatment duration of said treatment phases is determined by a timing control, and wherein, during all treatment phases, a pressure profile of an internal pressure of said container is detected, said method comprising with a pressure-measuring device, detecting an internal-pressure profile of a selected container only at a first filling element of said filling element group, and based at least in part on said internal-pressure profile, for all treatment phases of all filling elements of said filling element group, carrying out a step selected from a first group of steps, wherein said first group of steps consists of monitoring treatment duration, and correcting treatment duration.

2. The method of claim 1, further comprising comparing said internal-pressure profile with a nominal pressure profile for carrying out a step selected from a second group of steps, said second group of steps consisting of the union of said first group of steps and the steps of displaying a sequence of treatment phases, and monitoring of a sequence of treatment phases.

3. The method of claim 1, further comprising, prior to said first treatment phase, applying a further treatment phase, and detecting an internal-pressure profile within said container during said further treatment phase, wherein said further treatment phase is selected from the group consisting of evacuating said container and rinsing said container with inert gas.

4. The method of claim 3, wherein internal-pressure of said container during said further treatment phase is smaller than said counter-pressure.

5. The method of claim 3, wherein said further treatment phase comprises filling said container.

6. The method of claim 1, further comprising providing said pressure-measuring device at one filling position of a rotary filling machine having filling positions, wherein each of said filling positions comprises a filling element at a rotor, wherein said rotor is driven to rotate about a vertical machine axis.

7. The method of claim 1, further comprising providing said pressure-measuring device at a location that is diametrically opposed to another pressure-measuring device located at another filling position, wherein diametric opposition is in relation to a vertical machine axis of a rotor of a rotary filling machine having filling positions, each of which comprises a filling element at said rotor, wherein said rotor is driven to rotate about said vertical machine axis.

8. The method of claim 1, further comprising saving first data in a computer of said filling system, wherein said first data comprises data selected from the group consisting of container-specific data and product-specific data, wherein said first data comprises one of changed treatment duration, and corrected treatment duration.

9. An apparatus for controlling a filling system for pressure-filling containers with a liquid filling material in one multi-phase filling process using a filling-element group comprising a plurality of filling elements for filling said containers against a counter-pressure, wherein said counter-pressure is selected from the group consisting of a clamping pressure and a filling pressure, wherein said multi-phase treatment process comprises in a first treatment phase, pre-pressurizing a container with an inert gas to said counter-pressure, in a second treatment phase, filling said container to said counter-pressure, and in a third phase after said second phase, relieving said container to ambient pressure, wherein a control device provides timing control of one of treatment duration-said apparatus comprising a single pressure-measuring device, and a control device, wherein said single pressure-measuring device is configured for detecting an internal-pressure profile for all filling elements during said treatment phases, and wherein said control device is configured for providing timing control of treatment duration of said phases, said control device being configured for at least one of monitoring and correcting treatment durations of all treatment phases of all filling elements of said filling element group based at least in part on an internal-pressure profile detected by said pressure-measuring device.

10. The apparatus of claim 9, wherein said control device is further configured for comparing said internal-pressure profile with a nominal pressure profile and to cause an action selected from the group consisting of displaying a sequence of treatment phases, monitoring a sequence of treatment phases, changing a treatment duration, and correcting a treatment duration.

11. The apparatus of claim 9, wherein said control device is configured for correcting treatment duration of all treatment phases based at least in part on said pressure profile.

12. The apparatus of claim 9, wherein said pressure-measuring device is provided at one filling position of a rotary filling machine having a plurality of filling positions, each of which comprises a filling element at a rotor that is driven to rotate about a vertical machine axis.

13. The apparatus of claim 9, wherein said pressure-measuring device is provided opposite another pressure-measuring device that is located at a filling position that is diametrically opposed to said pressure-measuring device, wherein diametric opposition is in relation to a vertical machine axis of a rotary filling machine having a plurality of filling positions, each of which comprises a filling element at a rotor, wherein said rotor is driven to rotate about said vertical machine axis.

14. The apparatus of claim 9, wherein said control device is configured for saving information selected from the group consisting of a particular changed treatment duration, and a particular corrected treatment duration.

* * * * *